US006359592B1

(12) United States Patent
Chen et al.

(10) Patent No.: US 6,359,592 B1
(45) Date of Patent: Mar. 19, 2002

(54) MINIMUM FREQUENCY SHIFT TELESCOPING ANTENNA

(75) Inventors: Li Chen, Buffalo Grove; Enrico J. DiMario, Chicago; Eric Krenz, Crystal Lake; Roger Jellicoe, Woodstock; Richard Huang, Bloomingale, all of IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/710,292

(22) Filed: Nov. 10, 2000

(51) Int. Cl.[7] ..... H01Q 1/24
(52) U.S. Cl. ..... 343/702; 343/895; 343/901
(58) Field of Search ..... 343/702, 895, 343/900, 901, 906

(56) References Cited

U.S. PATENT DOCUMENTS 5,583,519 A * 12/1996 Koike ..... 343/702
5,594,459 A * 1/1997 Hirota ..... 343/702
5,856,808 A 1/1999 Holshouser et al. ..... 343/702
5,900,839 A 5/1999 Duperray ..... 343/702
6,087,994 A * 7/2000 Lechter ..... 343/702
6,091,369 A * 7/2000 Baek et al. ..... 343/702

* cited by examiner

*Primary Examiner*—Don Wong
*Assistant Examiner*—Hoang Nguyen
(74) *Attorney, Agent, or Firm*—Hisashi D. Watanabe

(57) ABSTRACT

A telescoping antenna (102) has a mast element (200) with first and second ends (204, 222), the first end (204) being mounted on a cellular telephone housing (206) and establishing electrical connection with signal processing circuitry (210) within the cellular telephone (208). The telescoping antenna (102) also has a cylindrical radiating element (202) that slidably engages the mast element (200). In a retracted or stowed position first ends (204, 212) of the mast element (200) and the cylindrical radiating element (202) are substantially adjacent, and second ends (222, 216) of the mast element (200) and the cylindrical radiating element (202) are also substantially adjacent. A loading coil (214) has a first end (218) permanently connected to the second end (216) of the cylindrical radiating element (202) and has a second end (220) engageable with the second end (222) of the mast element (200). The loading coil (214) engages the mast element (200) when the antenna (102) is in a stowed position, and is disconnected from the mast element (200) when the antenna (102) is in the deployed position. The antenna (102) provides a substantially constant frequency of operation in both an extended and retracted orientation.

25 Claims, 10 Drawing Sheets

MINIMUM FREQUENCY SHIFT TELESCOPING ANTENNA

FIELD OF THE INVENTION

The invention relates generally to antennas and methods and apparatus for receiving radio signals and for transmitting radio signals in conjunction with an electronic device such as a cellular telephone. In particular, the present invention relates to telescoping antennas for use with such cellular telephones.

BACKGROUND OF THE INVENTION

Many electronic devices use retractable antennas, that is, antennas which are extendible from and retractable into the housing of the electronic device. In electronic devices such as cellular telephones or other devices, the retractable antenna is electrically connected to a signal processing circuit that is contained within a housing of the cellular telephone on a printed circuit board. In order to optimally operate, the signal processing circuit and the antenna should be interconnected such that the respective impedances are substantially matched, and such that the antenna operates at a predetermined frequency or in a predetermined frequency range. Cellular telephones are becoming physically smaller in size, and this creates a problem with antenna systems used for these types of cellular telephones. The miniaturization causes complex mechanical and electrical connections, and it has been found that retractable antennas that retract into the housing of the cellular telephone are becoming prohibitive from a practical manufacturing standpoint.

U.S. Pat. No. 5,856,808 discloses a single feed point matching system for radiotelephones that includes a retractable antenna and a stationary ferrule contact which are configured to define a coaxial capacitor when the antenna is in an extended position. This prior art antenna still has a drawback because of a shift in frequency between operation in retracted and extended positions. U.S. Pat. No. 5,990,839 discloses a radio transmission apparatus having a retractable antenna for use with a transceiver. The disclosed retractable antenna has a first coil located around a rod antenna in a housing and a second coil connected to an extendible portion of the antenna. The coils disclosed are used for radiation of the signal both in the retracted and extended positions, which reduces the effectiveness of the antenna system.

Consequently, a need exists for a retractable antenna which can be used with cellular devices, which need not be contained within the housing of the cellular device, and which has a minimum frequency shift between a retracted or stowed position, and an extended or deployed antenna position.

BRIEF DESCRIPTION OF THE DRAWINGS

The invention may best be understood by reference to the following description taken in conjunction with accompanying drawings, in the several figures of which like numerals identify like elements.

DETAILED DESCRIPTION OF A PREFERRED EMBODIMENT OF THE INVENTION

In general, a telescoping antenna provides a substantially constant frequency of operation in both an extended position and a retracted position. The minimum frequency shift telescoping antenna of the present invention is used with a cellular telephone (such as Motorola model no. SUG1696AA), but can also be utilized for any type of electric device which receives and/or transmits radio signals. In one example of the present invention the antenna is mounted externally on the housing of the cellular telephone. The telescoping antenna has a mast element with first and second ends, the first end being mounted on the cellular telephone housing and establishing electrical connection with the signal processing circuitry within the cellular telephone. The antenna also has a cylindrical radiating element that slidably engages the mast element. In a retracted or stowed position first ends of the mast element and the cylindrical radiating element are substantially adjacent, and second ends of the mast element in the cylindrical element are also substantially adjacent. A loading coil element has a first end permanently connected to the second end of the cylindrical radiating element and has a second end engageable with the second end of the mast element. The loading coil element engages the mast element when the antenna is in the stowed position, and is disconnected from the mast element when the antenna is in the deployed position.

Figure 1A:
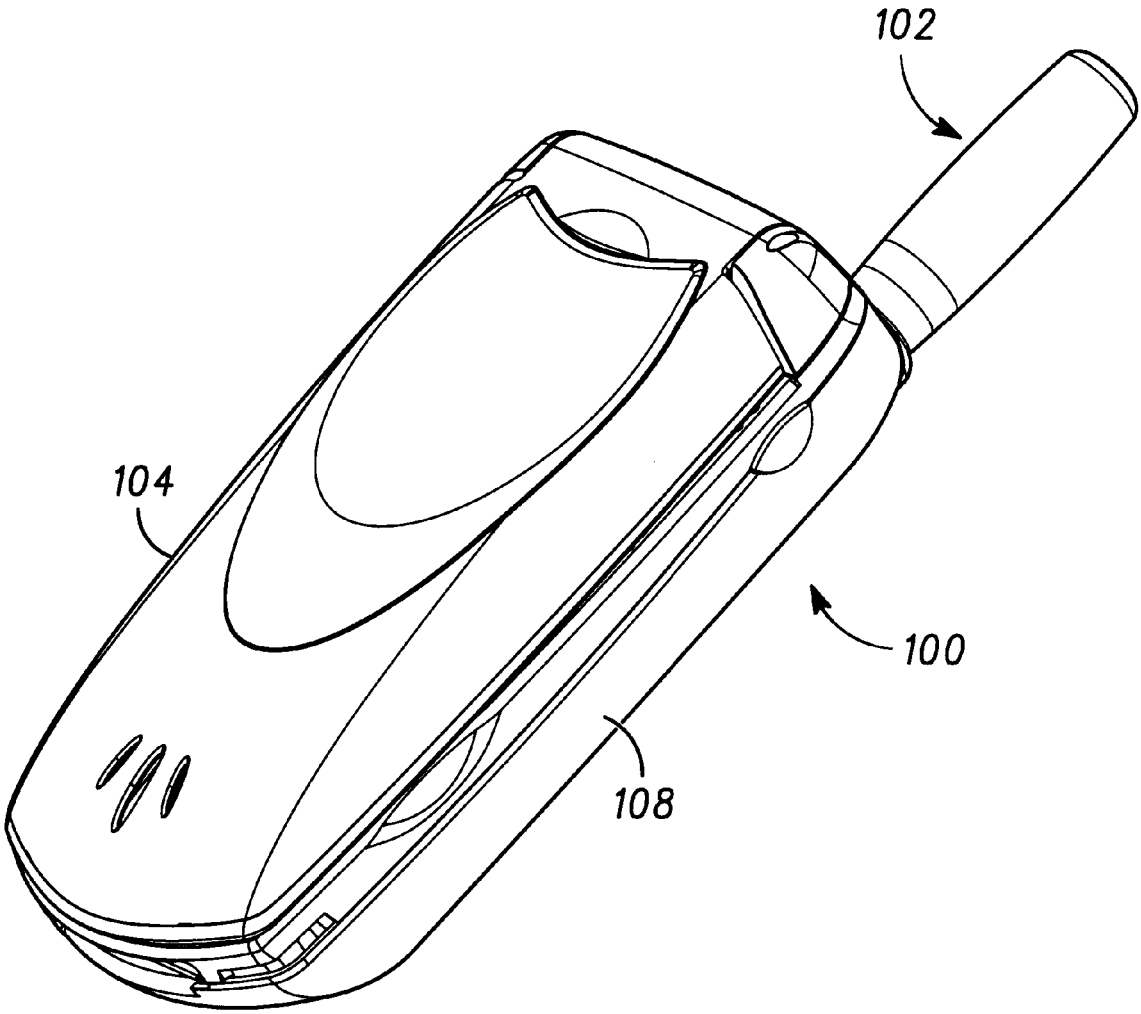
FIGS. 1A and 1B depict a cellular telephone having the retractable antenna according to the present invention.
Figure 1B:
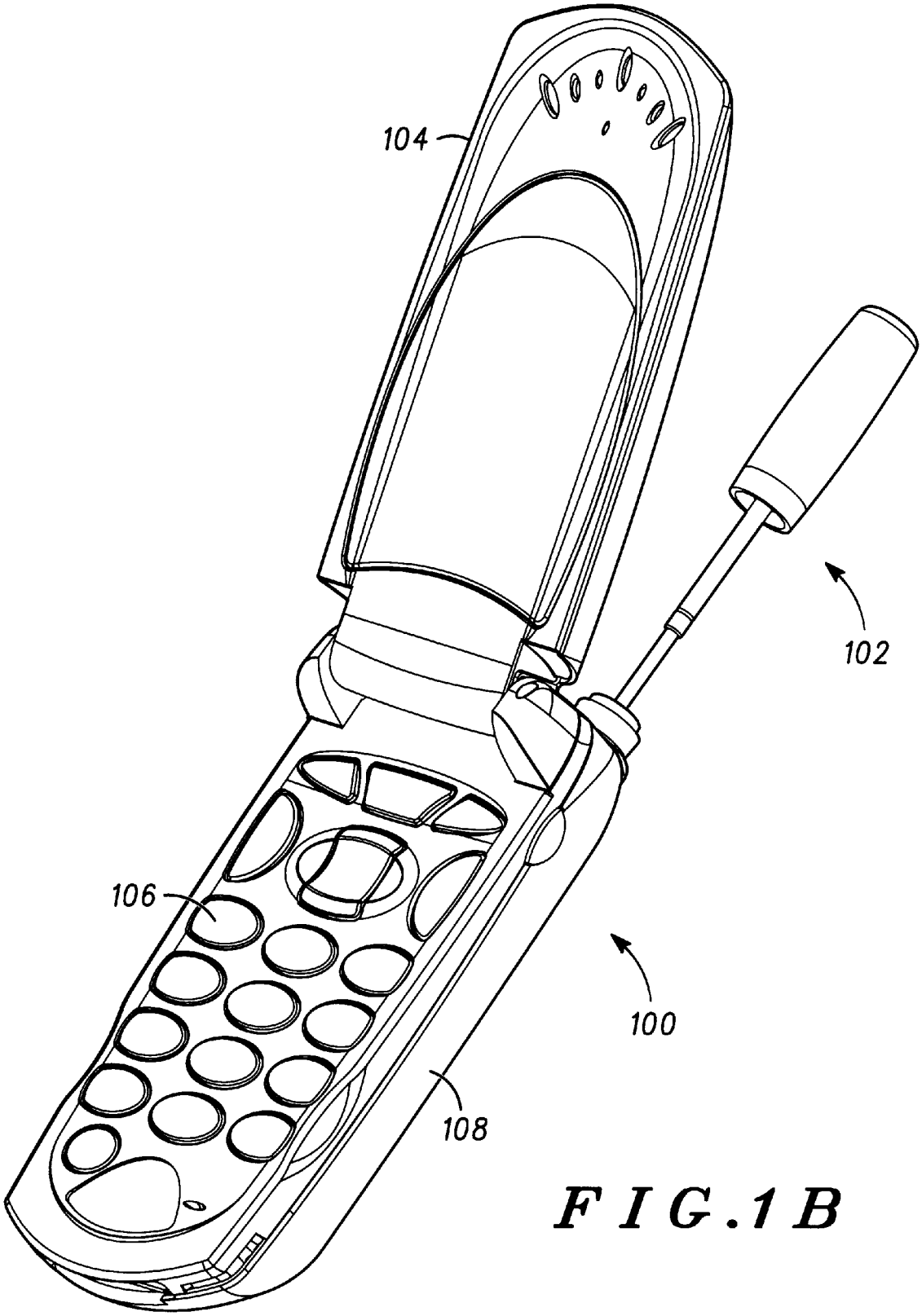

FIGS. 1A and 1B depict a clam shell-style cellular telephone 100. The clam shell-style cellular telephone 100 has an antenna 102 that is externally mounted on the cellular telephone 100. FIG. 1A depicts the cellular telephone 100 in a closed position and with the antenna 102 in a stowed position. FIG. 1B depicts the cellular telephone 100 in an open position and with the antenna 102 in a deployed position. In the closed position of the cellular telephone 100, a cover 104 covers keys 106 that are mounted on the body 108 of the cellular telephone 100. Prior art telescoping antennas typically suffer from frequency shift problems when the antenna is moved from the stowed position to the deployed position. In addition, the antenna for a metal clam shell-style cellular telephone is known to suffer from reduced bandwidth in the 800 MHz band when the clam shell-style telephone is RF (radio frequency) grounded. The metal clam shell design of this type of phone with a grounded flip has been known to reduce SAR (specific absorption rate), but also causes narrow bandwidth. A regular helical antenna can only provide 25 MHz of bandwidth. Also, when the antenna does not retract inside the housing of the cellular telephone, there is no simple way to detect the stowed and deployed antenna positions to facilitate a switchable match to the antenna. The novel antenna of the present invention efficiently solves the frequency shift issue and has a measured bandwidth of 40 MHz. Furthermore, the present invention provides an antenna that has a single match that serves for both the stowed and deployed positions of the antenna.

Figure 2:
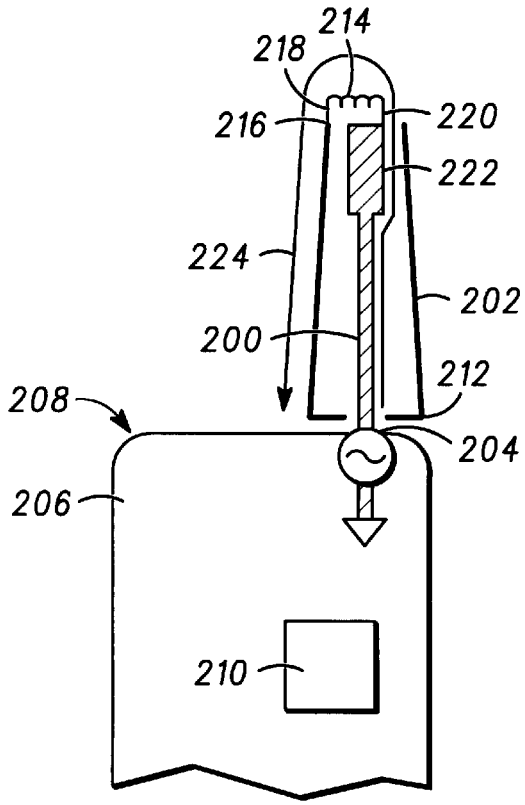
FIG. 2 schematically depicts the antenna of the present invention in a stowed or retracted position.
Figure 3:
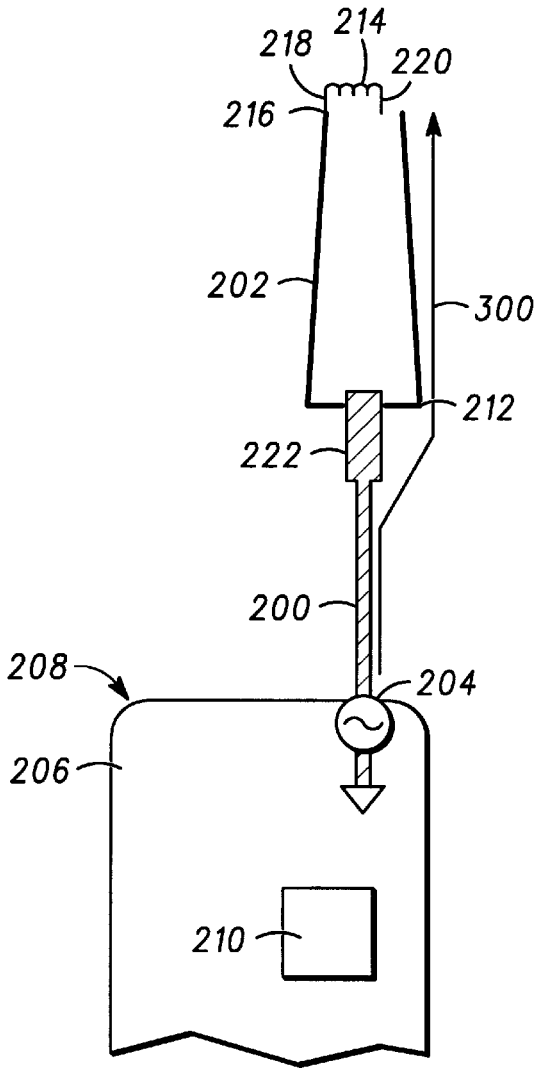
FIG. 3 schematically depicts the antenna of the present invention in a deployed or extended position.

When a prior art antenna is moved from the deployed to the stowed position, the change in its electrical length causes a frequency shift to a higher band for return loss. The further the antenna is extended, the more the frequency shifts. FIGS. 2 and 3 schematically depict the antenna of the present invention in a stowed position (FIG. 2) and in a deployed position (FIG. 3). The antenna has a mast element 200 on which a cylindrical radiating element 202 is slidably engageable. The mast element has a first end 204, which is mounted on the housing 206 of the cellular telephone 208 and which electrically connects to signal processing circuitry 210 in the cellular telephone 208. The cylindrical radiating element 202 has a first end 212 which is located substantially adjacent the first end 204 of the mast element 200 when the cylindrical radiating element 202 is in the stowed position. A loading coil 214 has its first end 218 connected to the second end 216 of the cylindrical radiating element 202. The loading coil 214 also has a second end 220, which is engageable with a second end 222 of the mast element 200 when the antenna is in the stowed position as depicted in FIG. 2. During operation of the cellular telephone 208, a current path 224 is established through the mast element 200, the loading coil 214 and the cylindrical radiating element 202 as depicted in FIG. 2.

In FIG. 3, the antenna is in the deployed position and the current flow path 300 occurs through the mast element 200 and then through the cylindrical radiating element 202. The cylindrical telescoping antenna of the present invention, when used on a metal clam shell-style cellular telephone 208, has very good performance at a very low SAR with good efficiency and bandwidth. The telescoping antenna of the present invention also has the advantage of requiring no space inside the cellular telephone 208. In the prior art it was difficult to obtain a perfect match for both the stowed and deployed positions of the antenna when using a single match. This is because when the antenna is moved from the deployed to the stowed position, the change in electrical length causes a frequency shift to a higher band with return loss. This disadvantage of the prior art is overcome by the antenna of the present invention. When the antenna is in the deployed position (FIG. 3), the loading coil 214 does not significantly affect antenna performance because the loading coil 214 is located at the open end of the antenna (second end 216 of the cylindrical radiating element 212). When the antenna is in the stowed position, the loading coil 214 connects the mast element 200 to the cylindrical radiating element 202. Therefore, the effect of a loading coil 214 on the antenna performance in the stowed position (inductive loading increasing the antenna's electrical length) is significantly increased, while the loading coil 214 has no effect on tuning the antenna in the deployed position. The resonant frequency with the antenna stowed is pulled back to the lower band, so that it corresponds to the resonance of the antenna in the deployed position. The resonant frequency for the retracted or stowed position can be selected by adjusting the length of the loading coil 214. Measurement data has shown that the antenna of the present invention has excellent bandwidth in the stowed position for an RF grounded metal flip style cellular telephone. This antenna achieved a good bandwidth and good radiation efficiency, especially in the 800 MHz band, reaching 45%–64% throughout the band in the normal use position. Also it maintains a very low SAR, especially for 800 MHz band, which is the most difficult band to establish a low SAR.

Figure 4:
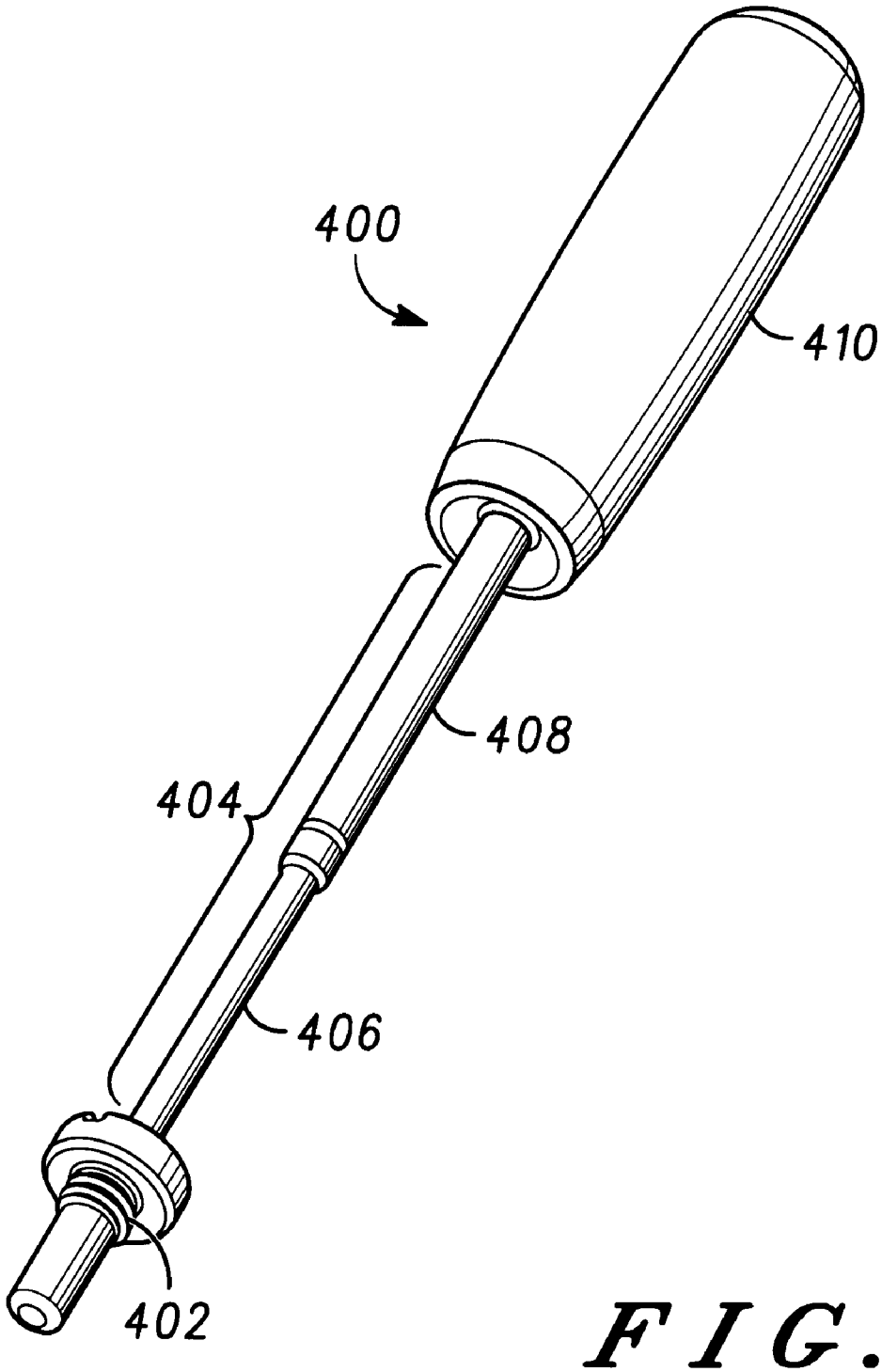
FIG. 4 is a perspective view of an example of an antenna according to the present invention.

FIG. 4 is a perspective view of the antenna of the present invention. The antenna 400 has a threaded connector 402, which mechanically and electrically connects to the cellular telephone. It electrically connects to the signal processing circuitry 210 but not to the ground or metal housing of the telephone. In this embodiment, the mast element 404 has two sections, 406 and 408, which telescope. Section 408 telescopes over section 406 to stow the antenna 400. The cylindrical radiating element 410 slides over the section 408 of the mast element 404 for the stowed position of the antenna 400. The antenna 400 is shown in the deployed position in FIG. 4. It is to be understood that the mast element 404 could be of one fixed length or could have a plurality of telescoping sections.

Figure 5:
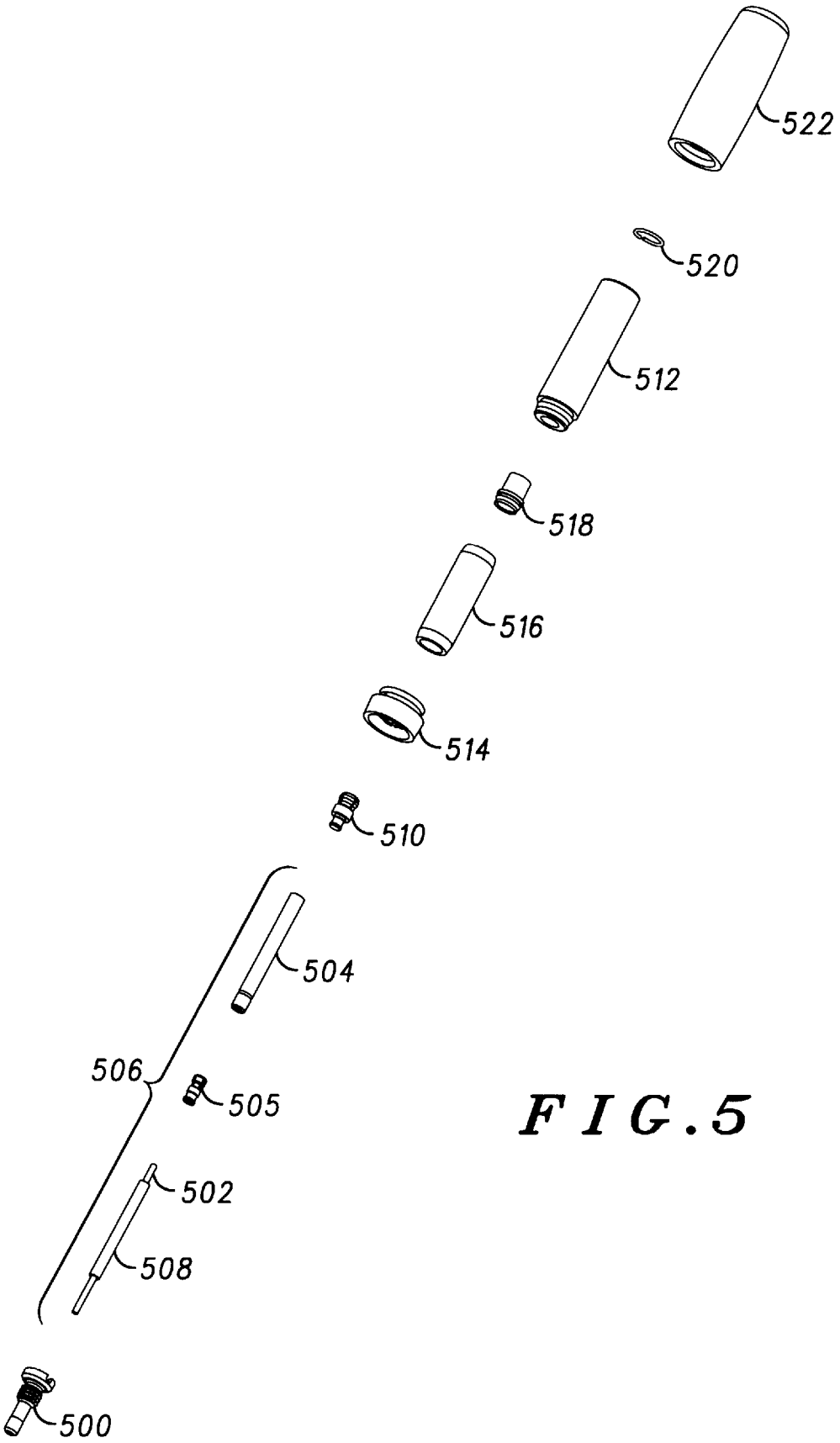
FIG. 5 is an exploded perspective view of the components of one example of an antenna of the present invention.

FIG. 5 is an exploded perspective view of one embodiment of the antenna of the present invention. A threaded connector 500 provides mechanical and electrical connection to the cellular telephone. A nickel titanium wire, or a wire of an equivalent material forms a nickel titanium rod 502, which forms one section of the mast element 506. The rod 502 has an insulating sleeve 508. A second section of the mast element 506 is a ferrule tube 504, which is formed of stainless steel with, for example, a black chrome finish or other suitable finish. A lower sliding contact 505 and an upper stop contact 510 provide the mechanism for allowing the mast element 506 to be able to telescope. The cylindrical radiating element 512 is formed of a brass material or any equivalent material. The cylindrical radiating element 512 contains a bushing 514, an insulator 516 and an inside contact bushing 518, which is composed of a brass material. This assembly of elements 514, 516 and 518 allows the cylindrical radiating element 512 to slidably engage the mast element 506. The cylindrical radiating element 512 also contains a loading coil, which in this embodiment is a single flat coil 520. In this embodiment, the single flat coil 520 is formed from music wire which is carbon steel. The cylindrical radiating element 512 also has a plastic shell 522, which covers the cylindrical radiating element 512.

Figure 6:
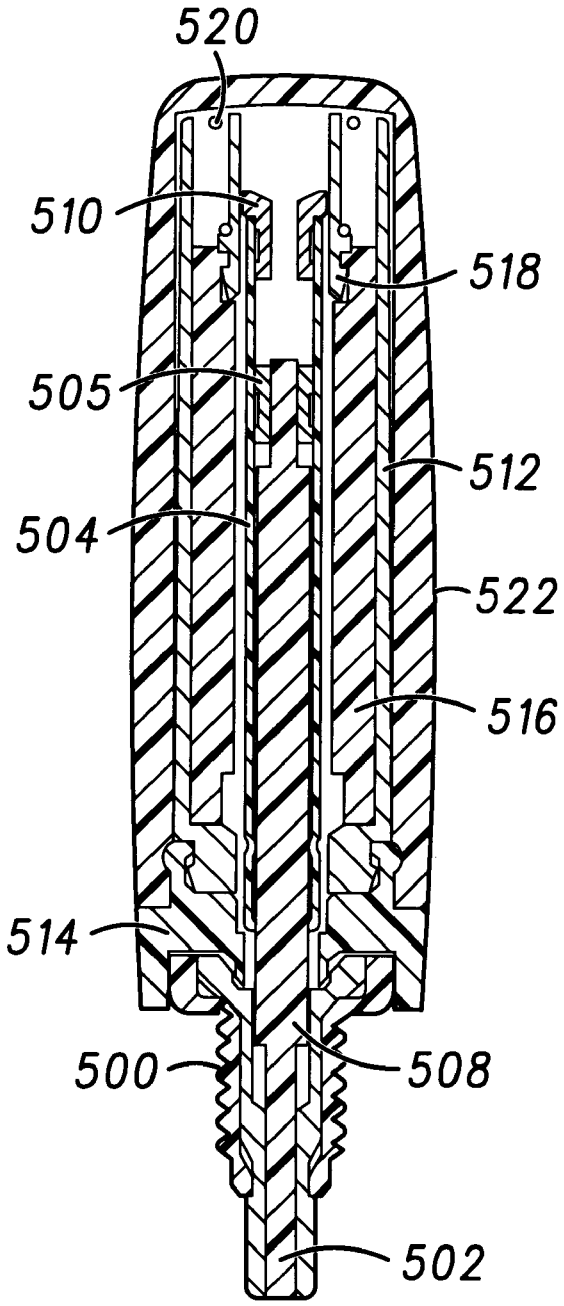
FIG. 6 is a cross-sectional view of one example of an antenna according to the present invention in a retracted position.
Figure 7:
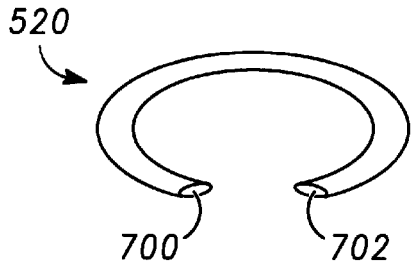
FIG. 7 depicts one embodiment of a loading coil according to one example of the present invention and as used in the FIG. 6 antenna.

FIG. 6 is a cross sectional view of the antenna depicted in FIG. 5 in a stowed position. In this stowed position the loading coil 520 establishes electrical connection to the mast element 506 via the upper stop contact 510 and the inside contact bushing 518. FIG. 7 is a drawing of the single loading coil 520. In the disclosed embodiment, the loading coil 520 has a first end 700, which is soldered or crimped to the cylindrical radiating element 512. A second end 702 of the loading coil 520 is soldered or crimped to the inside contact bushing 518.

Figure 8:
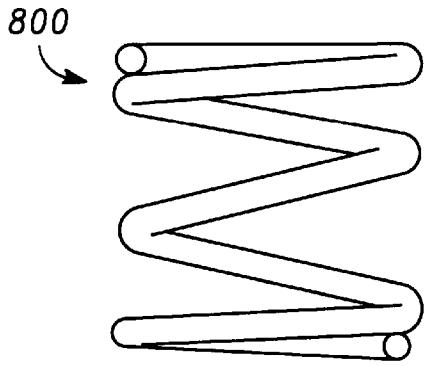
FIGS. 8 and 9 depict an alternative embodiment of a loading coil for use with one example of an antenna of the present invention.
Figure 9:
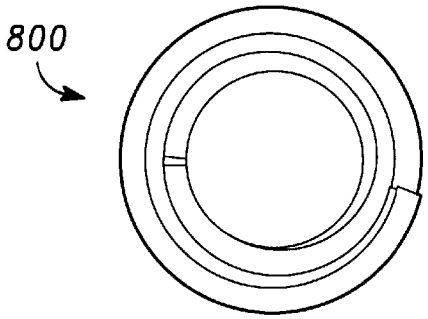
Figure 10:
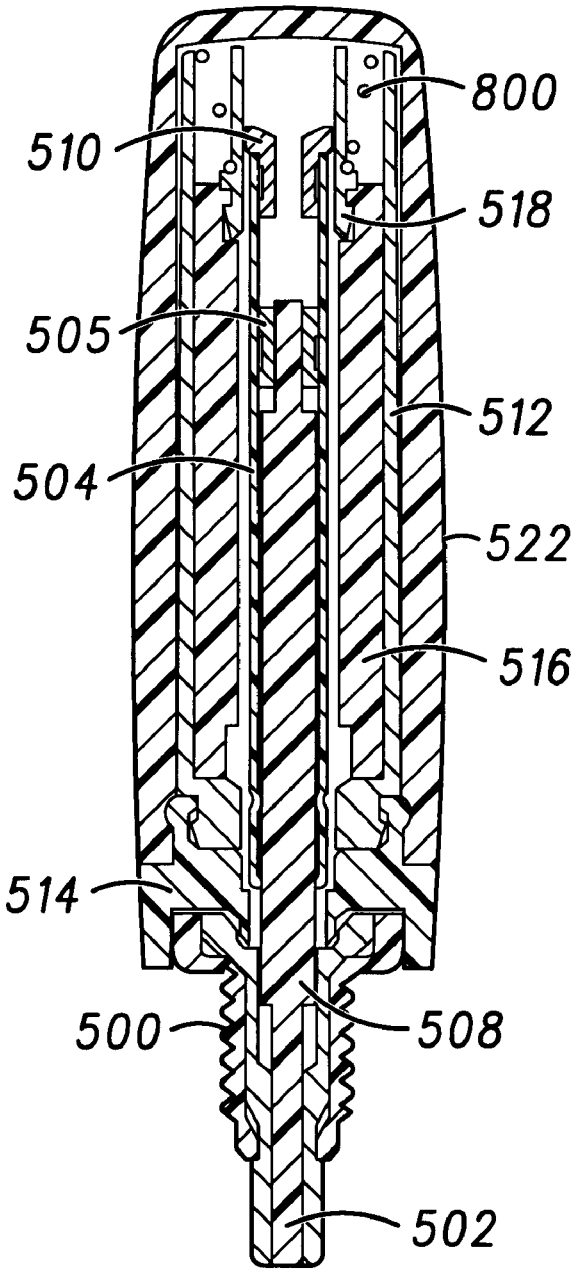
FIG. 10 is a cross-sectional view of one example of an antenna of the present invention in a retracted position and using the loading coil as depicted in FIGS. 8 and 9.

FIGS. 8 and 9 depict an alternative embodiment of the loading coil 800. In this embodiment, the loading coil 800 forms a right hand helix with a coil pitch of 2 mm. The coil is formed from carbon steel music wire. The loading coil 800 is depicted in a cross-sectional view of the antenna of the present invention in FIG. 10.

Figure 11:
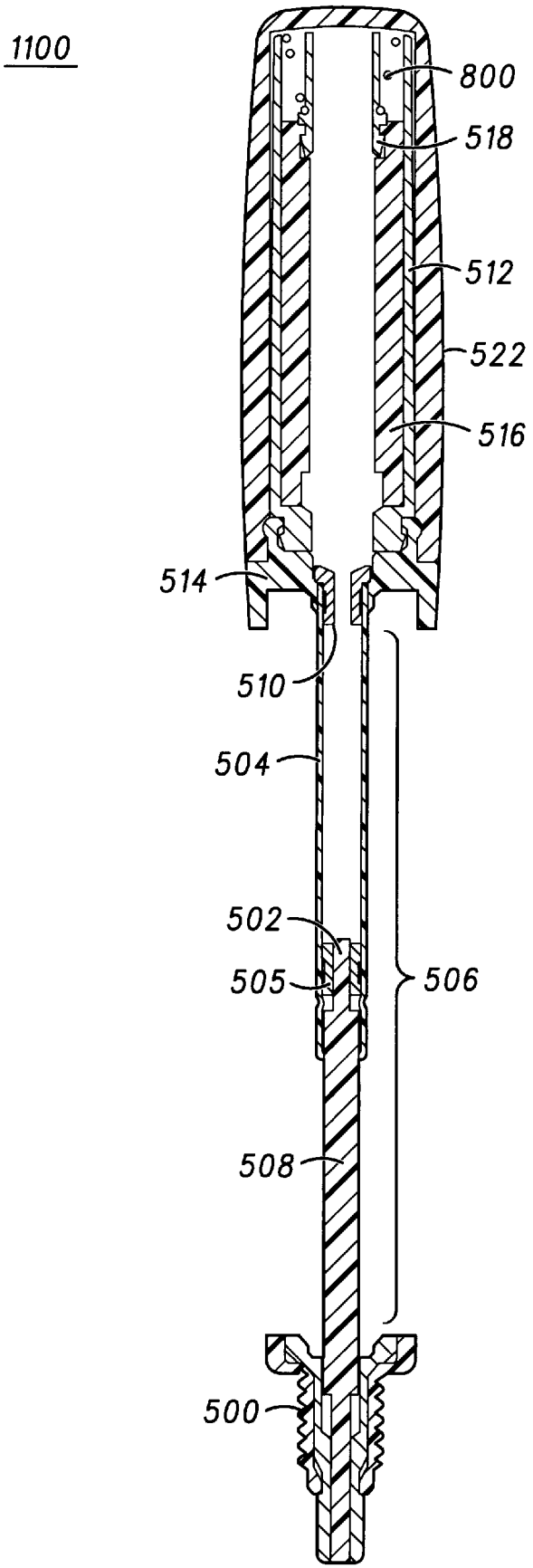
FIG. 11 is a cross-sectional view of one example of an antenna of the present invention in an extended or deployed position.
Figure 12:
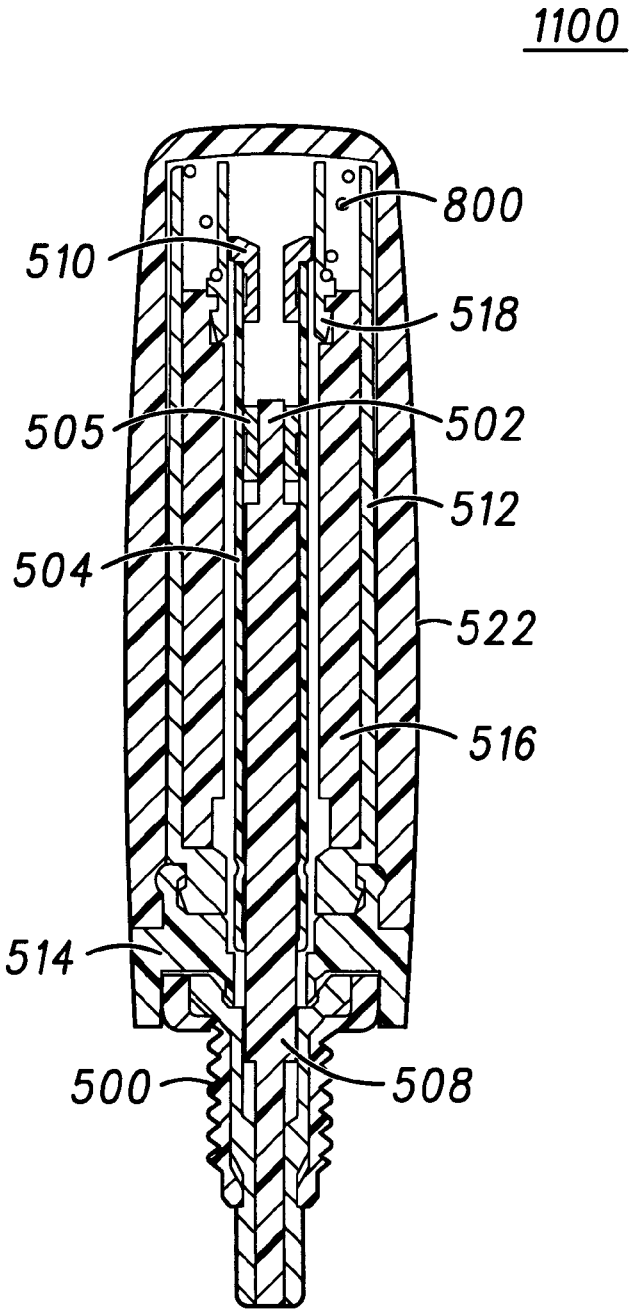
FIG. 12 is a further cross-sectional view of one example of an antenna of the present invention in a retracted or stowed position.

FIGS. 11–12 are further cross-sectional views of the antenna 1100 according to the present invention. FIG. 11 depicts the antenna 1100 in a stowed or retracted position, while FIG. 12 depicts the antenna 1100 in an extended or deployed position. In the retracted position, as depicted in FIG. 11, the antenna 1100 has an overall length of approximately 38 mm, and in the deployed position the antenna has an overall length of 62 mm.

Thus, the present invention fulfills a need in the prior art of providing a telescoping antenna for use on electrical devices, such as a cellular telephone, which is externally mounted and which provides a substantially constant frequency of operation in both an extended and retracted orientation. The antenna of the present invention has the advantage of having the same matching in the retracted and extended position thereby eliminating the requirement for switchable matching elements. The antenna of the present invention also has improved bandwidth for an RF grounded flip-style cellular telephone when the antenna is in the retracted position, as compared to a helical monopole antenna. Furthermore, the antenna of the present invention has a very low SAR in both the retracted and extended positions, when employed on a metal clamshell cellular telephone.

The present invention is not limited to the particular details of the apparatus depicted and other modifications and applications are contemplated. Certain other changes may be made in the above-described apparatus without departing from the true spirit or the scope of the invention herein involved. For example, the antenna of the present invention can be readily usable with any type of electronic equipment that transmits and/or receives radio signals. Furthermore, various lengths of the antenna in both the retracted and extended positions (as a function of the number of telescoping sections utilized) are accomplished by the present invention, as well as other slidably engageable mechanisms for connecting the mast element to the cylindrical radiating element, such as the cylindrical radiating element not being centered on the mast element. In addition, other configurations of the loading coil are within the teachings of the present invention, such as loading coils which have more or less number of turns than those depicted in the preferred embodiment, as well as other configurations other than helical. It is intended, therefore, that the subject matter in the above depiction shall be interpreted as illustrative and not in a limiting sense.

What is claimed is:

1. An antenna system for use with an electronic device having a housing and at least a processing module, comprising:

a mast element having first and second ends, the first end mechanically connected to the housing of the electronic device and electrically coupled to the processing module in the electronic device;

a radiating element slideably engageable with the mast element, the radiating element having first and second ends;

a loading coil mounted on the second end of the radiating element and having first and second ends, the first end of the loading coil electrically connected to the second end of the radiating element;

the radiating element having a stowed position defined by the radiating element being in a retracted position over at least a part of the mast element such that the second end of the loading coil is electrically connected the second end of the mast element; and the radiating element having a deployed position defined by the radiating element being in an extended position relative to the mast element such that the first end of the radiating element is connected to the second end of the mast element, the second end of the loading coil thereby being electrically disconnected from the mast element.

2. The antenna system according to claim 1, wherein the mast element has a telescoping configuration.

3. The antenna system according to claim 1, wherein the radiating element has a substantially cylindrical configuration.

4. The antenna system according to claim 1, wherein the radiating element substantially surrounds the mast element and is telescopeable over the mast element.

5. The antenna system according to claim 1, wherein the loading coil is configured such that a frequency of operation of the antenna system is substantially constant for the stowed and deployed position of the radiating and mast elements.

6. The antenna system according to claim 1, wherein the loading coil has a substantially helical configuration.

7. The antenna system according to claim 1, wherein the loading coil has a substantially flat configuration.

8. The antenna system according to claim 1, wherein, in the stowed position, the antenna system has a current path from the processing module through the mast element from the first to the second ends thereof, through the loading coil from the second to the first ends thereof, and through the radiating element from the second to the first ends thereof, and wherein, in the deployed position, the antenna system has a current path through the mast element from the first to the second ends thereof, and through the radiating element from the first to the second ends thereof.

9. An antenna system, comprising:

an electronic device having a housing and at least a signal processing module;

a telescoping antenna including a mast element having first and second ends, the first end of the mast element mechanically connected to the housing of the electronic device and electrically coupled to the processing module in the electronic device, a radiating element slideably engageable with the mast element, the radiating element having first and second ends, and a loading coil assembly having a loading coil mounted on the second end of the radiating element, the loading coil having first and second ends, the first end of the loading coil electrically connected to the second end of the radiating element;

the telescoping antenna having a stowed position defined by the radiating element being in a retracted position over at least a part of the mast element such that the second end of the loading coil is electrically connected to the second end of the mast element; and the telescoping antenna a deployed position defined by the radiating element being in an extended position relative to the mast element such that the first end of the radiating element is connected to the second end of the mast element, the second end of the loading coil thereby being electrically disconnected from the mast element.

10. The antenna system according to claim 9, wherein the radiating element has a substantially cylindrical configuration.

11. The antenna system according to claim 9, wherein the loading coil is configured such that a frequency of operation of the antenna system is substantially constant for the stowed and deployed position of the radiating and mast elements.

12. The antenna system according to claim 9, wherein the loading coil has a substantially helical configuration.

13. The antenna system according to claim 9, wherein the loading coil has a substantially flat configuration.

14. The antenna system according to claim 9, wherein, in the stowed position, the antenna has a current path from the processing module through the mast element from the first to the second ends thereof, through the loading coil from the second to the first ends thereof, and through the radiating element from the second to the first ends thereof, and wherein, in the deployed position, the antenna has a current path through the mast element from the first to the second ends thereof, and through the radiating element from the first to the second ends thereof.

15. The antenna system according to claim 9, wherein the electronic device is a cellular telephone, and wherein the telescoping antenna is externally mounted on the cellular telephone.

16. The antenna system according to claim 9, wherein the electronic device is a radio frequency grounded metal clam shell style cellular telephone, and wherein the antenna is externally mounted on the cellular telephone.

17. An antenna system, comprising:

at least first and second telescoping sections;

upper and lower connector components connected to the first and second telescoping sections;

a loading coil assembly;

the lower connector component electrically connecting the first and second sections when the first and second sections are in an extended position relative to one another; and the upper connector electrically connecting the loading coil assembly between the first and second sections when the first and second sections are in a retracted position relative to one another.

18. The antenna system according to claim 17, wherein:

the first telescoping section is a mast element having first and second ends;

the second telescoping section is a radiating element slideably engageable with the mast element, the radiating element having first and second ends;

the loading coil assembly has a loading coil mounted on the second end of the radiating element, the loading coil having first and second ends, the first end of the loading coil electrically connected to the second end of the radiating element.

19. The antenna system according to claim 18, wherein:

the radiating element has a stowed position defined by the radiating element being in a retracted position over at least a part of the mast element such that the second end of the loading coil is electrically connected the second end of the mast element; and the radiating element has a deployed position defined by the radiating element being in an extended position relative to the mast element such that the first end of the radiating element is connected to the second end of the mast element, the second end of the loading coil thereby being electrically disconnected from the mast element.

20. The antenna system according to claim 19, wherein the radiating element has a substantially cylindrical configuration.

21. The antenna system according to claim 19, wherein the radiating element substantially surrounds the mast element and is telescopeable over the mast element.

22. The antenna system according to claim 19, wherein the loading coil is configured such that a frequency of operation of the antenna system is substantially constant for the stowed and deployed position of the radiating and mast elements.

23. The antenna system according to claim 19, wherein the loading coil has a substantially helical configuration.

24. The antenna system according to claim 19, wherein the loading coil has a substantially flat configuration.

25. The antenna system according to claim 19, wherein, in the stowed position, the antenna system has a current path from the processing module through the mast element from the first to the second ends thereof, through the loading coil from the second to the first ends thereof, and through the radiating element from the second to the first ends thereof, and wherein, in the deployed position, the antenna system has a current path through the mast element from the first to the second ends thereof, and through the radiating element from the first to the second ends thereof.

* * * * *